US008210665B2

(12) United States Patent
Herman

(10) Patent No.: US 8,210,665 B2
(45) Date of Patent: Jul. 3, 2012

(54) CONSTANT FLOW VALVE MECHANISM

(75) Inventor: John L. Herman, Huber Heights, OH (US)

(73) Assignee: Eastman Kodak Company, Rochester, NY (US)

( * ) Notice: Subject to any disclaimer, the term of this patent is extended or adjusted under 35 U.S.C. 154(b) by 1040 days.

(21) Appl. No.: 12/105,603

(22) Filed: Apr. 18, 2008

(65) Prior Publication Data

US 2009/0260691 A1 Oct. 22, 2009

(51) Int. Cl.
*B41J 2/175* (2006.01)

(52) U.S. Cl. ..... 347/85

(58) Field of Classification Search ..... 251/324, 251/214; 137/625.48, 625.66, 12; 347/89, 347/85, 7, 87; 60/328
See application file for complete search history.

(56) References Cited

U.S. PATENT DOCUMENTS 2,485,504 A * 10/1949 Morgan ..... 251/324
2,505,809 A * 5/1950 Svenson ..... 60/328
2,782,801 A * 2/1957 Ludwig ..... 137/625.48
3,605,810 A 9/1971 Moroney
4,494,124 A * 1/1985 Piatt et al. ..... 347/89
4,503,886 A 3/1985 Simpson, Jr.
4,520,369 A * 5/1985 Shackleton ..... 347/85
4,887,643 A * 12/1989 Tomlin et al. ..... 137/625.66
5,297,777 A * 3/1994 Yie ..... 251/214
5,418,557 A * 5/1995 Pullen ..... 347/7
5,624,409 A 4/1997 Seale
5,880,748 A 3/1999 Childers et al.
6,099,113 A 8/2000 Blouin et al.
6,408,882 B1 6/2002 Smith, Jr.
6,428,156 B1 8/2002 Waller et al.
6,485,137 B2 11/2002 Karlinski et al.
6,840,605 B2 1/2005 Hauck
6,877,846 B2 4/2005 Fellingham et al.

* cited by examiner

*Primary Examiner* — Stephen Meier
*Assistant Examiner* — Carlos A Martinez
(74) *Attorney, Agent, or Firm* — William R. Zimmerli

(57) ABSTRACT

A constant flow valve mechanism for use in an inkjet printer includes a valve. A first port, a second port, and a third port are in fluid communication with each other through the valve. A portion of the valve is moveable and associated with the first, second, and third ports to produce a change in fluid impedance between the first port and the second port and the first port and the third port such that the fluid impedance between the first port and the second port changes at the same rate and in an opposite direction as that of the fluid impedance between the first port and the third port.

18 Claims, 6 Drawing Sheets

CONSTANT FLOW VALVE MECHANISM

FIELD OF THE INVENTION

The present invention relates generally to valves and, more particularly, to constant flow valves used in ink jet printing systems.

BACKGROUND OF THE INVENTION

The final, or "last chance," filter currently used in ink jet printers is made of a polypropylene mesh, with its primary function being to protect the nozzles of the printhead from contamination of dirt or other foreign particles. It is known that particles above 1.2 μm in size can enter the printhead and adversely affect the printhead. For example, the particles can block nozzles or cause jet ejection in a non-perpendicular direction.

The changes in pressure that occur, for example, during start up allow particles that have been trapped by the filter to reorient themselves, allowing them to pass through the filter in a process called shedding. In other industries requiring high purity liquids, prior art solutions don't use the last chance filter, but rather employ a fluid system with large flow of fluid continuously recirculating through a main filter, with only a small portion of this flow available for use. However, this solution does not address the pressure shock associated with bringing the system pressure up to jetting pressure, nor does it provide for an entire system flush following servicing. Additionally, the elimination of the last chance filter does not allow for the replacement of parts, such as the printhead module, as dirt introduced into the fluid lines when the part is replaced would not be filtered out before entering the printhead.

Diverter valves are known, see, for example, U.S. Pat. No. 6,408,882 issued to Smith on Jun. 25, 2002, but not used in the ink jet industry. U.S. Pat. No. 6,408,882 discloses a Y-shaped diverter valve wherein an actuator moves the valve spool so as to allow fluid communication between the main port and only one of two secondary valves. The quick change in valve position creates a pressure surge, which pulses back to the filter, resulting in shedding.

U.S. Pat. No. 3,605,810, issued to Moroney on Sep. 20, 1971, discloses a flow diverter valve to be used with a flow meter loop. To maintain flow rate across a meter, the valve directs fluid from the inlet port through a loop, which can be open to the outlet port. When the outlet port is closed, fluid in the loop pushes against a piston thereby actuating a meter.

Pre-existing diverter valves have several drawbacks. For example, conventional diverter valves shut off flow to one output before shifting flow to a second output, and do not open the second port at the same rate that the first port is being closed. Additionally, conventional diverter valves cannot be adjusted such that both outputs are open to enable some of the fluid to bypass. Furthermore, conventional diverter valves drag their seals across the port which can cause the seals to break down, thereby generating particles that could contaminate the nozzles, thereby reducing the lifetime of the printhead.

Accordingly, the need exists for a diverter valve that provides a constant rate of flow and reduces the likelihood of shedding.

SUMMARY OF THE INVENTION

According to a feature of the present invention, a constant flow valve mechanism for use in an inkjet printer includes a valve. A first port, a second port, and a third port are in fluid communication with each other through the valve. A portion of the valve is moveable and associated with the first, second, and third ports to produce a change in fluid impedance between the first port and the second port and the first port and the third port such that the fluid impedance between the first port and the second port changes at the same rate and in an opposite direction as that of the fluid impedance between the first port and the third port.

According to another feature of the present invention, a method of operating a constant flow valve mechanism includes providing a valve; providing a first port, a second port, and a third port in fluid communication with each other through the valve; and moving a portion of the valve associated with the first, second, and third ports to produce a change in fluid impedance between the first port and the second port and the first port and the third port such that the fluid impedance between the first port and the second port changes at the same rate and in an opposite direction as that of the fluid impedance between the first port and the third port.

According to another feature of the present invention, an inkjet printing apparatus includes a constant flow valve mechanism, a fluid tank, and a drop generator. The constant flow valve mechanism includes a valve. A first port, a second port, and a third port are in fluid communication with each other through the valve. A portion of the valve is moveable and associated with the first, second, and third ports to produce a change in fluid impedance between the first port and the second port and the first port and the third port such that a fluid impedance between the first port and the second port changes at the same rate and in an opposite direction as that of a fluid impedance between the first port and the third port. The fluid tank is in fluid communication with the constant flow valve mechanism through one of the first, second, and third ports of the constant flow valve mechanism. The drop generator is in fluid communication with the constant flow valve mechanism through another of the first, second, and third ports of the constant flow valve mechanism. The drop generator is also in fluid communication with the fluid tank.

Another feature of the invention uses the hollow internal passage of the valve spool to connect the first port to the second and third ports. That is, fluid flows from the first port through the hollow internal passage, through a cross-bore in the valve spool and into the cavity between the valve spool and the hollow external chamber, the cavity being in fluid communication with the second port, the third port, or both the second and third ports.

According to another feature of the invention, the valve mechanism slowly changes position to allow the impedance of the input to remain constant while adjusting the impedance of the outputs. For example, the invention can be used to reduce or even eliminate shedding of the last chance filter in an ink jet printing system. Using the invention, shedding can be reduced by running the system on bypass until the jetting pressure is achieved and then slowly diverting the fluid path to run through the drop generator. This allows the system to establish the appropriate pressure drop across the filter without the risk of particles which have been shed by the filter clogging the nozzles. In another example embodiment, cleaning fluid can be run through the system at jetting pressure and the valve can slowly change to allowing ink to flow through the system, preventing any pulsing of pressure on the filters.

Advantageously, the invention permits one or more fluids to be pumped through the system with constant fluid impedance, reducing pressure pulsing on the filters. As pressure pulsing on the filters can result in the shedding of particles which can clog the drop generator, slowly diverting the path of the fluids can reduce the number of clogged nozzles.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described can take various forms well known to those skilled in the art. In the description that follows, identical reference signs have been used, when possible, to identify identical components.

Figure 1:
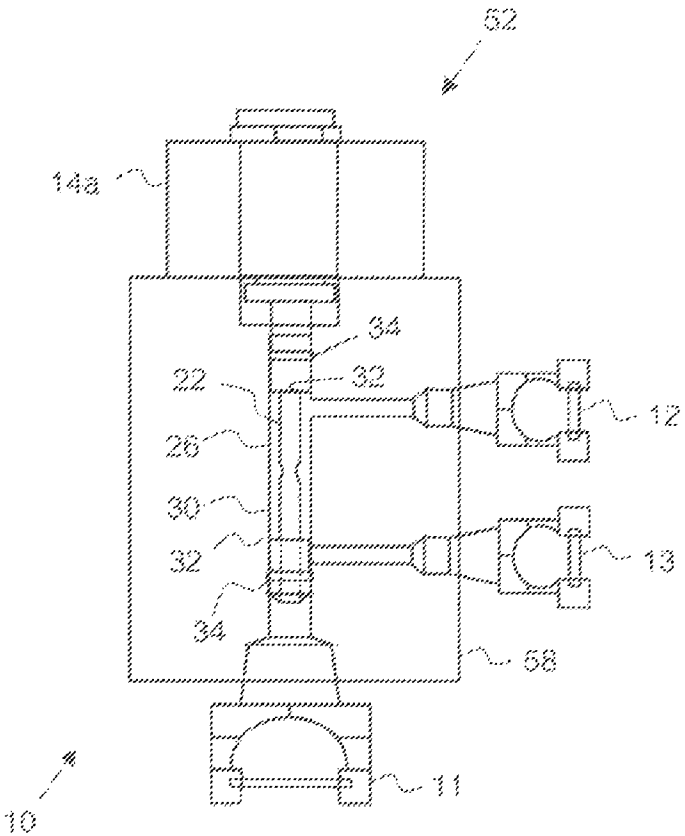
FIG. 1 is a schematic illustration of a first example embodiment of a constant flow valve according to the present invention.

Referring to FIG. 1, a schematic of an example first embodiment of a valve mechanism 52 for use in an inkjet printer is shown. Valve mechanism 52 includes the constant flow valve 10 and an actuator 14. The constant flow valve 10 includes a first port 11, a second port 12, and a third port 13 in fluid communication with each other. Actuator 14 is operatively associated with valve spool 22 to move the valve spool 22 to change the fluid impedance between the first port 11 and the second port 12 and between the first port 11 and the third port 13. In an example embodiment of the present invention, actuator 14 is a solenoid 14*a*. When solenoid 14*a* is used, the solenoid is connected to valve spool 22 and energizing the solenoid 14*a* moves valve spool 22 in a linear motion. By controlling the current to the solenoid 14*a*, the valve spool 22 position can be varied.

Figure 2:
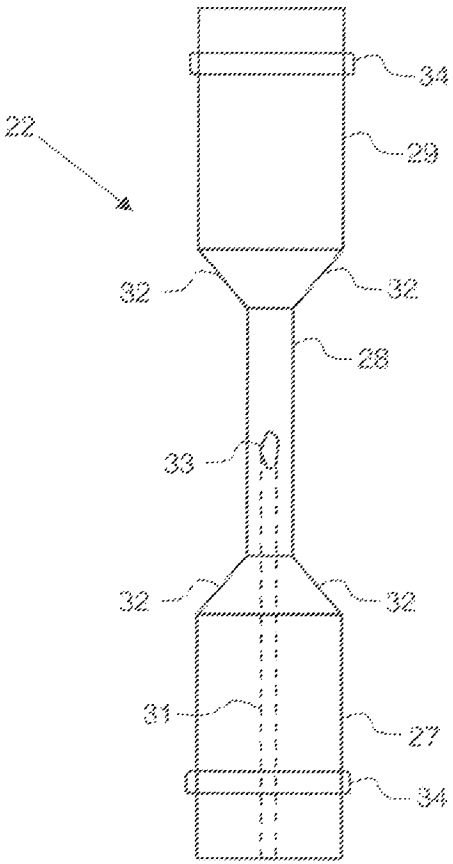
FIG. 2 is a schematic illustration of an example embodiment of a valve spool according to the present invention.

Referring to FIG. 2, the valve spool 22 has a first section 27, a second section 28, and a third section 29, and the cross-section of the first section 27 and cross-section of the third section 29 are greater than the cross-section of the second section 28. Referring back to FIG. 1, valve spool 22 is located within a hollow chamber 26 such that the first section and third section are a tight, but slip, fit. Both the valve spool 22 and hollow chamber 26 are made from material which is compatible with the system fluids, such as stainless steel or plastic, though other materials can be used provided they resist deterioration. It is preferable that valve spool 22 be made from the same material as hollow chamber 26 so as to undergo the same amount of thermal expansion. Valve spool 22 fits within hollow chamber 26 and the smaller cross-section of the second section 28 of the valve spool 22 defines a cavity 30 within hollow chamber 26. Cavity 30 is further defined by shoulders 32 located on the valve spool 22 at the transition from the first section 27 to the second section 28 and at the transition of the second section 28 to the third section 29. The spacing of the shoulders 32 equals the spacing between the second and third ports of the valve body 58 such that when one shoulder is positioned at the top edge of the second port 12 the second shoulder is positioned at the top edge of the third port 13. As shown in FIG. 2, the valve spool 22 includes a hollow internal passage 31 which extends from the end of the valve spool 22 adjacent to the first port 11 to a cross-bore 33 located in the second portion 28 of the valve spool 22. This enables first port 11 to be in fluid communication via the internal passage 31 and the cross-bore 33 with cavity 30.

Figure 3:
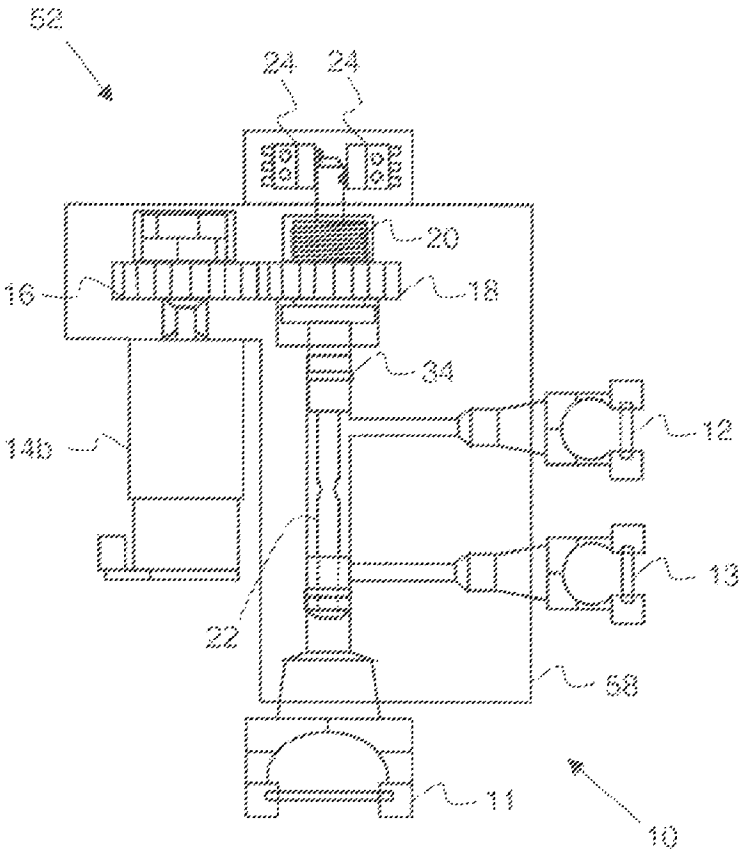
FIG. 3 is a schematic illustration of a second example embodiment of a constant flow valve according to the present invention.

When valve spool 22 moves up or down within the chamber 26, the shoulders 32 also move up and down blocking or enabling flow from port 11 to the ports 12 and 13. When the valve spool 22 is in a first location, as shown in FIG. 1, the first port 11 is in fluid communication with the second port 12 through cavity 30, but is isolated from the third port 13. When valve spool 22 is moved within hollow chamber 26 to a second location, as shown in FIG. 3, the first port 11 and the third port 13 are in fluid communication through the cavity 30, but it is isolated from the second port 12. For valve spool 22 positions between the first location and the second location, the shoulders 32 only partially block both the second and third ports 12 and 13 so that the first port 11 is in fluid communication with both the second port 12 and the third port 13 through cavity 30. Moving the valve spool 22 upward, as shown in FIG. 3, causes the second port 12 to be occluded at the same rate that the third port 13 is opened (with the reverse happening when the valve spool 22 moves downward, as shown in FIG. 3). The flow impedance between the first and second ports therefore increases at the approximately the same rate as the flow impedance between the first and third ports decreases. In this sense, the fluid impedance between the first port and the second port changes at the same rate and in an opposite direction as that of the fluid impedance between the first port and the third port.

The movement from the first location to the second location is controlled in order to reduce or even eliminate a surge in pressure, known to create shedding.

Fluid within the cavity 30 is prevented by the shoulders 32 and o-rings 34 from escaping from any location other than through third port 13. The shoulders 32 contact the sides of the hollow chamber 26 to minimize fluid leakage. Fluid within cavity 30 is prevented by the shoulders 32 from escaping from any location other than through the second port 12. Additionally, o-rings 34 are located around valve spool 22 on the first section 27 and on the third section 28 and outside the shoulders 32 such that they do not cross the second and third ports 12 and 13 when valve spool 22 moves. This helps to prevent degradation of the o-rings 34 and the production of particles downstream of filter 36 which could cause printhead failure. The o-rings 34 help to prevent fluid from leaking past the valve spool 22 into the valve actuating mechanism.

The shoulders 32 on the valve spool 22 can be sharp as shown in FIGS. 1 and 3, or they can be tapered as shown in FIG. 2. By appropriately tapering the shoulders 32 one can alter the fluid flow impedance profile during the transition between open and closed. Similarly the shape of the openings of second port 12 and third port 13 can also be altered to adjust the rate of change of fluid impedance during the transitions. By using shoulder taper profiles and port shapes that are symmetric about the midline between the respective shoulders and ports, the valve mechanism 52 controls the rate of change of fluid impedance such that the rate of change in fluid impedance between the first port 11 and the second port 12 is equal to the rate of change in fluid impedance between the first port 11 and the third port 13 but in an opposite direction. This equal and opposite change in fluid impedance minimizes the change in flow rate through port 1 during a cycling of the valve which reduces the likelihood of shedding of particles from a filter that is coupled with port 1.

In another example embodiment of the present invention, shown in FIG. 3, actuator 14 is a motor 14*b*, for example, a servo motor or a stepper motor. The gear motor 14*b* turns a drive gear 16 which in turn drives a driven gear 18. A portion of valve spool 22 includes a threaded portion 20 which interacts with the internal threads of driven gear 18 in order to move the valve spool 22 either up or down as shown in FIG. 3 to change the fluid impedance between the first port 11 and the second port 12 and between the first port 11 and the third port 13. When actuator 14 is a gear motor 14*b*, there is also included a key (not shown) to engage the valve spool 22 to prevent valve spool 22 from rotating within hollow chamber 26.

In selecting a motor, it is desirable that the motor should be one with an attached gear reduction for high torque and low speed. The low output speed allows for higher positional resolution of the valve spool to be attained while the high torque provided by the gear reduction, allows the use of a smaller motor. It is desirable to make the driven gear 18 from a low-friction material that also resists wear. This is because driven gear 18 transmits thrust on all surfaces as the gear rotates. For example, driven gear 18 can be made from Teflon, stainless steel, or other types of materials that resist premature wear and also offer a low-friction surface for interaction with the other gear. One advantage of the gear motor actuator embodiment is that there is less heat conduction to valve 10 from actuator 14 because gear motor 14*b* is geared off from valve 10. This reduction in heat conduction is important in reducing or even eliminating the sticking of the valve spool 22 which can result from the increasing temperature of the valve 10 leading to ink drying in the valve 10.

In one embodiment of the present invention, the top of valve spool 22 is in contact with two end of stroke limit switches 24, which function as a feedback device. The travel time between the two limit switches 24 is one way to determine the position of valve spool 22. However, the position of valve spool 22 can also be determined by counting pulses in a servo motor, counting steps in a stepper motor, or any other method that is apparent to one skilled in the art. Using the position of valve spool 22 in accordance with a feedback device, it is possible to achieve a particular pressure or flow rate from either port 12 or 13 in applications where such is desired. This allows the user to control the pressure and/or flow rate which helps reduce or eliminate shedding from filter 36. Valve components are enclosed by a valve body 58 to provide a neat package.

In some fluid system embodiments of the present invention, the first port 11 is an input port such that fluid flows from the first port 11 toward the second port 12 and the third port 13, discussed in more detail below with reference to FIG. 4. In alternate embodiments of the present invention, the first port 11 is an output port such that fluid flows from the second port 12 and the third port 13 toward the first port 11, discussed in more detail below with reference to FIG. 5. Regardless of the fluid flow direction, the fluid flow path between first port 11, second port 12, and third port 13 is created using the hollow internal passage 31 and the cross-bore 33 of the valve spool 22, cavity 30, and hollow chamber 26.

Figure 4:
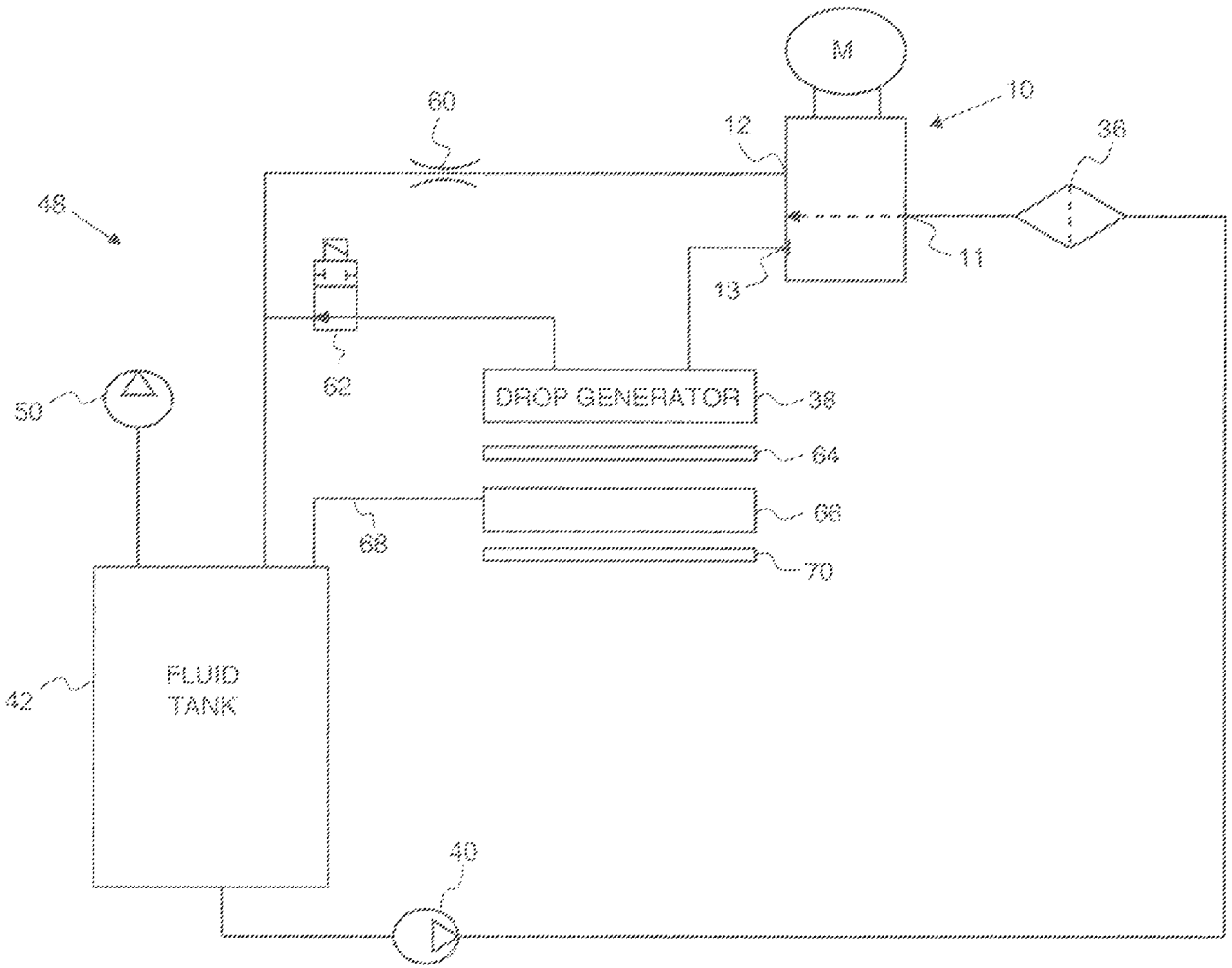
FIG. 4 is a schematic illustration of an example embodiment of the fluid system of an ink jet printer including a constant flow valve according to the present invention where the constant flow valve has one input and two output ports.

Referring to FIG. 4, an inkjet printer fluid system 48 is shown. Fluid system 48 contains a fluid tank 42, from which a fluid, such as ink, can be supplied under pressure by fluid pump 40 through filter 36, commonly referred to as a last chance filter, and valve 10 to the drop generator 38. Drop generator 38 can be any type of drop generator known in the art, such as described in U.S. Pat. No. 4,999,647 or 6,851,796, both assigned to the Eastman Kodak Company in Rochester, N.Y. While in print mode, constant flow valve is set so that at least a portion of the flow passing through constant flow valve 10 is directed through port 13 to the drop generator 38. Outlet valve 62 is closed so that the drop generator becomes pressurized causing the fluid to be jetted from one or more nozzles. Stimulation means associated with the drop generator cause the jetted fluid to break up into drops. Deflection means 64 cause selected drops to be deflected while other drops are not deflected. Catcher 66 catches one of the deflected or undeflected drops allowing the other to strike the print media. The fluid is returned from the catcher 66 to the fluid tank 42 through return line 68, assisted by vacuum applied to the fluid tank 42 by vacuum pump 50. As ink pump 40 is started up, the ink flows through the constant flow valve 10 from the first port 11 to the second port 12, passes through restrictor 60, and returns to the fluid tank 42, bypassing the drop generator 38. This pressurizes the last chance filter 36 and establishes the operating flow and pressure drop across filter 36. Typically, the time the system is run so that it bypasses drop generator 38 is based on the particle shedding characteristics of filter 36. Once the flow rate has been established and the likelihood of particle shedding has been decreased, the constant flow valve 10 is actuated such that the first port 11 is shut off from the second port 12 and is in fluid communication with the third port 13. This redirects the ink flow through drop generator 38 without producing a pressure pulse at the filter 36 thereby reducing the likelihood of the filter to shed particles which can adversely affect the drop generator 38. Outlet valve 62 is closed during this transition of the constant flow valve 10. Alternatively the constant flow valve can be transitioned while the outlet valve 62 is open. With outlet valve 62 open, the fluid will pass through and will rinse away any dried ink from the drop generator 38. After a period of rinsing the drop generator 38 in this manner, the outlet valve 62 may be closed so that fluid pressure in the drop generator 38 will rise to the operating pressure for proper drop formation. In this way the constant flow valve 10 provides an improved startup method that reduces the risk of particles shedding from the filter 36 to produce a failure in the drop generator 38. An additional benefit of the fluid system shown in FIG. 4 is that it provides a novel method for servo controlling the ink pressure in the drop generator 38. The constant flow valve 10 is adjusted to direct some flow to both the drop generator 38 and to the restrictor 60 through the second port 12 and third port 13 respectively. By altering the flow split between the second and third ports the ink pressure at the drop generator can be adjusted. The use of the constant flow valve 10 for controlling the pressure allows the variable speed pump to be replaced with a lower cost or more reliable fixed speed pump.

Figure 5:
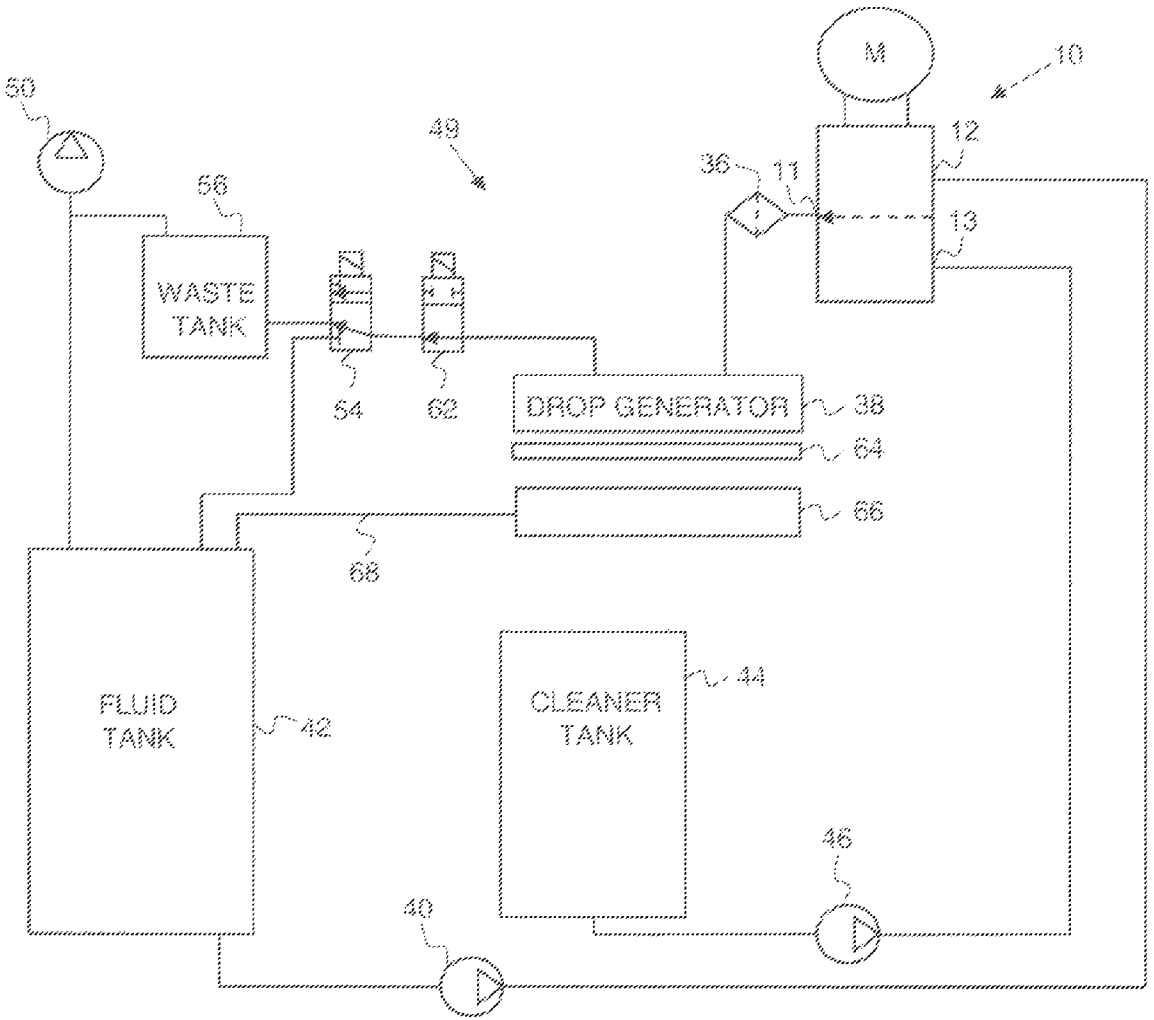
FIG. 5 is a schematic illustration of an example embodiment of the fluid system of an ink jet printer including a constant flow valve according to the present invention where the constant flow valve has two input and one output ports.

Referring to FIG. 5, an inkjet printer fluid system 49 is shown. The constant flow valve 10 is located in the fluid system 48 before filter 36. Fluid system 49 contains a fluid tank 42, for example, an ink tank, which is in fluid communication with the drop generator 38 through fluid pump 40 and valve 10. A vacuum pump 50 is also in fluid communication with fluid tank 42, to assist in returning ink from the drop generator 38 and the catcher 66. Additionally, fluid system 49 contains a cleaner tank 44, which is in fluid communication with the drop generator 38 through cleaner pump 46 and valve 10. In this embodiment, first port 11 functions as an output port which leads to filter 36 while second port 12 and third port 13 function as input ports. Second port 12 is connected to fluid tank 42 and third port 13 is connected to cleaner tank 44.

As the cleaner pump 46 is started up, third port 13 is in fluid communication with the first port 11. Cleaner pump 46 is increased to the jetting pressure. The cleaner fluid flows from the cleaner tank 44 through the constant flow valve 10 from the third port 13 to the first port 11, through filter 36, through the drop generator 38, and to waste tank 56 through outlet valve 62 and waste valve 54. Waste valve 54 can be a three-way valve commonly used in the art, or alternatively, can be a second valve according to the present invention. This allows the jetting pressure to be established before ink begins to flow through the system. Fluid pump 40 can be turned on so that ink is supplied to second port 12 at the jetting pressure. With both the ink and the cleaner fluids supplied to the second and third ports respectively at jetting pressure, the constant flow valve 10 is actuated such that the first port 11 is shut off from third port 13 and brought into fluid communication with second port 12. The constant flow valve enables the flow to the drop generator to be smoothly transitioned from the cleaning fluid to the ink with minimal disturbance to the fluid stream straightness and with minimal change in flow rate through the filter 36, preventing pressure pulses on the filter 36 which is known to result in shedding The actuation of valve 10 stops the flow of cleaner fluid through fluid system 49 and enables the flow of ink from fluid tank 42 through fluid system 49. Once the flow of cleaning fluid has ceased, fluid pump 46 is turned off and waste valve 54 is actuated so that the flow is shut off from flowing to waste tank 56 and is instead directed back to fluid tank 42.

Figure 6:
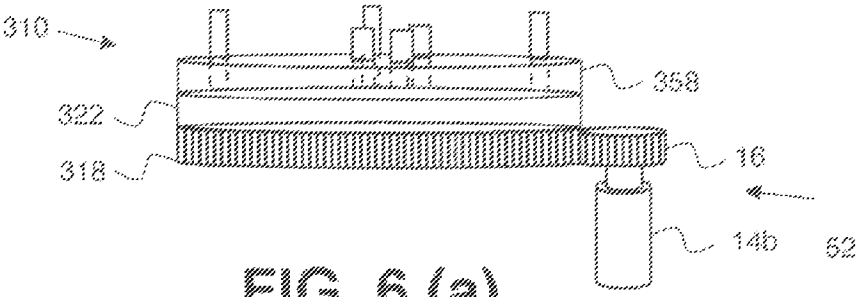
FIGS. 6(*a*) through 6(*c*) are schematic illustrations of an example embodiment of a rotary constant flow valve according to the present invention.
Figure 6:
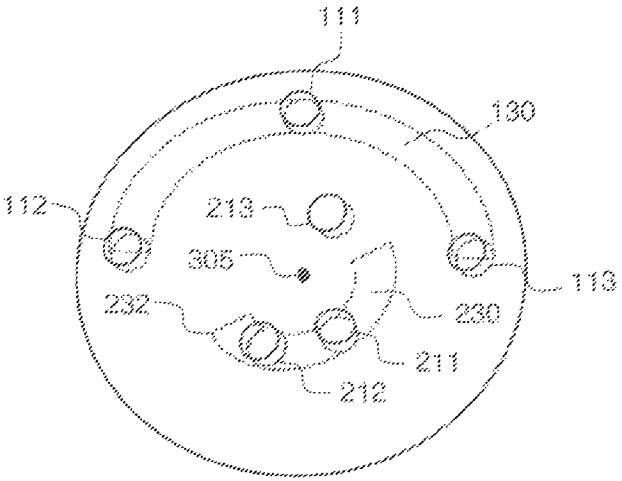
Figure 6:
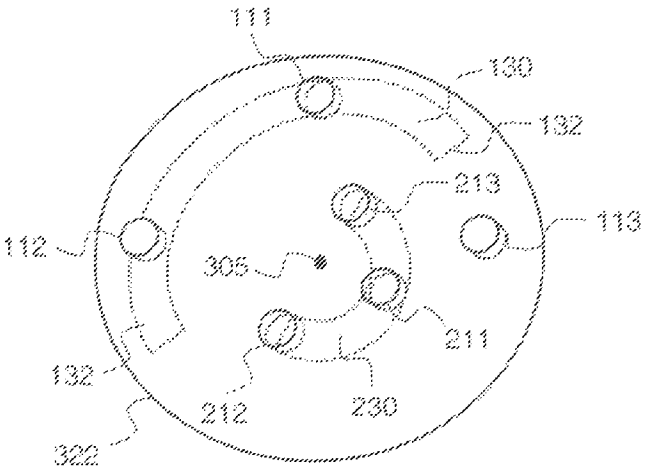

While the first and second constant flow valves of FIGS. 1-3 were linear actuation valves, the constant flow valve 10 can be a rotary valve as shown in FIG. 6(*a*). Also illustrated in FIGS. 6(*a*) through 6(*c*) is a valve system where a single actuator can be used to control more than one constant flow valve, in this embodiment two constant flow valves. As both valves have the same structure, only one of these valves will be described. Rotary valve 310 comprises a stationary manifold base 358 having a plurality of fluid ports, a rotary disk 322 rigidly coupled to a driven gear 318, the driven gear 318 being driven by drive gear 16 and an actuator 14. The rotary disk 322 is pressed tightly against manifold base 358 and can be rotated around pivot axis 305. Referring to FIGS. 6(*b*) and 6(*c*), the manifold base 358 has first, second and third ports 111, 112, and 113, respectively. In a preferred embodiment, the three ports are spaced a common distance out from the pivot axis 305. The rotary disk contains a cavity 130 preferably in the form of an arc of constant width. End walls 132 of the cavities in the present embodiment correspond to the shoulders 32 of the valve spool 22 in the linear action valve embodiment, and the angular spacing between the end walls 132 of the cavities is equal to the angular spacing between the second port 112 and third port 113. The first port 111 is in fluid communication with cavity 130 in the rotary disk 322. As the rotary disc 322 is turned, the end walls or shoulders 132 of the cavity 130 are rotated to either block or open passage to second and third ports 112 and 113. When the rotary disc 322 is in a first location, the first port 111 is in fluid communication with the second port 112 through the cavity 130. As motor 14(*b*) is actuated, rotary disc 322 is moved, closing the second port 12 (or third port 13) at the same rate the third port 13 (or second port 12) is opened. Just as with the first valve embodiment in FIG. 1, the fluid impedance between the first port and the second port changes at the same rate and in an opposite direction as that of the fluid impedance between the first port and the third port.

The second valve in FIGS. 6(*a*) through 6(*c*), has a similar structure to the first valve in these figures. The two valves have features that are fluidically isolated from each other by virtue of both different radial spacing from the pivot axis 305. The two valves have different angular orientations so that the transition of the fluid flow between the second and third ports for the one valve occurs at a different rotation angle than the transition for the second valve.

The invention has been described in detail with particular reference to certain preferred embodiments thereof, but it will be understood that variations and modifications can be effected within the scope of the invention.

PARTS LIST

10—Constant flow valve
11—First port
12—Second port
13—Third port
14—Actuator
14(*a*)—Solenoid
14(*b*)—Gear motor
16—Drive gear
18—Driven gear
20—Threads
22—Valve spool
24—Limit switch
26—Hollow chamber
27—First section
28—Second section
29—Third section
30—Cavity
32—Shoulder
34—O-ring
36—Filter
38—Drop generator
40—Fluid pump
42—Fluid tank
44—Cleaner tank
46—Cleaner pump
48—Fluid system
49—Fluid System
50—Vacuum pump
52—Valve mechanism
54—Waste valve
56—Waste tank
58—Valve Body
60—Restrictor
62—Outlet Valve
111—First port
112—Second port
113—Third port
130—Cavity
132—End walls
211—First port
212—Second port
213—Third port
230—Cavity
232—End walls
305—Pivot axis
318—Driven Gear
322—Rotary disc
358—Manifold base

The invention claimed is:

1. An inkjet printing apparatus comprising:

a constant flow valve mechanism comprising:

a valve; and a first port, a second port, and a third port in fluid communication with each other through the valve, a portion of the valve being moveable and associated with the first, second, and third ports to produce a change in fluid impedance between the first port and the second port and the first port and the third port, the first port being an input port such that fluid flows from the first port toward the second and third ports;

a fluid tank in fluid communication with the constant flow valve mechanism through the first port of the constant flow valve mechanism, the fluid tank being in fluid communication with the constant flow valve through the second port of the constant flow valve;

a drop generator in fluid communication with the constant flow valve mechanism through the third port of the constant flow valve mechanism, the drop generator also being in fluid communication with the fluid tank; and an actuator operatively associated with the moveable portion of the valve to change the fluid impedance between the first port and the second port and between the first port and the third port such that the fluid impedance between the first port and the second port changes at the same rate and in an opposite direction as that of a fluid impedance between the first port and the third port.

2. The apparatus of claim 1, further comprising:

a filter in fluid communication with the fluid tank and the first port of the constant flow valve mechanism.

3. The apparatus of claim 1, wherein the valve further comprises:

a hollow chamber; and a valve spool, the valve spool having a first section, a second section, and a third section, the first, second, and third sections each having a cross-section, and wherein the cross-section of the first section and the cross section of the third section are greater than the cross section of the second section, the valve spool being located within the hollow chamber such that a cavity is defined between second section of the valve spool and the hollow chamber, the valve spool being in fluid communication with the cavity and the first port.

4. The apparatus of claim 3, the valve spool including a pair of shoulders located spaced apart from each other, one of the pair of shoulders being located at the transition of the first section of the valve spool to the second section of the valve spool, and the other of the pair of shoulders being located at the transition of the third section of the valve spool to the second section of the valve spool to block a corresponding one of the second port and the third port depending on the location of the valve spool relative to the second port and the third port.

5. The apparatus of claim 4, wherein the actuator is operatively associated with the valve spool to move the valve spool relative to the second port and the third port to change the fluid impedance between the first port and the second port and the first port and the third port.

6. The apparatus of claim 4, the valve spool including a pair of o-rings positioned spaced apart from each other on the first and third sections of the valve spool at locations that do not allow the pair of o-rings to cross either the second port or the third port regardless of the location of the valve spool relative to the second port and the third port.

7. The apparatus of claim 1, wherein the actuator comprises a motor and a mechanism that transforms rotary motion provided by the motor to linear motion to move the valve.

8. The apparatus of claim 1, wherein the actuator comprises a solenoid.

9. The apparatus of claim 1, wherein the valve is a rotary valve.

10. An inkjet printing apparatus comprising:

a constant flow valve mechanism comprising:

a valve; and a first port, a second port, and a third port in fluid communication with each other through the valve, a portion of the valve being moveable and associated with the first, second, and third ports to produce a change in fluid impedance between the first port and the second port and the first port and the third port, the first port being an output port such that fluid flows to the first port from the second and third ports;

a first fluid tank in fluid communication with the constant flow valve mechanism through the second port of the constant flow valve mechanism; and a drop generator in fluid communication with the constant flow valve mechanism through the first port of the constant flow valve mechanism, the drop generator also being in fluid communication with the first fluid tank;

a second fluid tank in fluid communication with the constant flow valve mechanism through the third port of the constant flow valve mechanism; and an actuator operatively associated with the moveable portion of the valve to change the fluid impedance between the first port and the second port and between the first port and the third port such that the fluid impedance between the first port and the second port changes at the same rate and in an opposite direction as that of the fluid impedance between the first port and the third port.

11. The apparatus of claim 10, further comprising:

a filter in fluid communication with the drop generator and the first port of the constant flow valve mechanism.

12. The apparatus of claim 10, wherein the valve further comprises:

a hollow chamber; and a valve spool, the valve spool having a first section, a second section, and a third section, the first, second, and third sections each having a cross-section, and wherein the cross-section of the first section and the cross section of the third section are greater than the cross section of the second section, the valve spool being located within the hollow chamber such that a cavity is defined between second section of the valve spool and the hollow chamber, the valve spool being in fluid communication with the cavity and the first port.

13. The apparatus of claim 12, the valve spool including a pair of shoulders located spaced apart from each other, one of the pair of shoulders being located at the transition of the first section of the valve spool to the second section of the valve spool, and the other of the pair of shoulders being located at the transition of the third section of the valve spool to the second section of the valve spool to block a corresponding one of the second port and the third port depending on the location of the valve spool relative to the second port and the third port.

14. The apparatus of claim 13, further comprising:

an actuator operatively associated with the valve spool to move the valve spool relative to the second port and the third port to change the fluid impedance between the first port and the second port and the first port and the third port.

15. The apparatus of claim 13, the valve spool including a pair of o-rings positioned spaced apart from each other on the first and third sections of the valve spool at locations that do not allow the pair of o-rings to cross either the second port or the third port regardless of the location of the valve spool relative to the second port and the third port.

16. The apparatus of claim 10, wherein the actuator comprises a motor and a mechanism that transforms rotary motion provided by the motor to linear motion to move the valve.

17. The apparatus of claim 10, wherein the actuator comprises a solenoid.

18. The apparatus of claim 10, wherein the valve is a rotary valve.

* * * * *